United States Patent [19]

Kanzaka

[11] 3,988,812

[45] Nov. 2, 1976

[54] SLIDER FOR ADJUSTABLE FASTENING DEVICE

[75] Inventor: Yoshihiro Kanzaka, Nyuzen, Japan

[73] Assignee: Yoshida Kogyo Kabushiki Kaisha, Japan

[22] Filed: Nov. 19, 1974

[21] Appl. No.: 525,069

[30] Foreign Application Priority Data

Nov. 21, 1973 Japan ..... 48-134845[U]

[52] U.S. Cl. ..... 24/206 B

[51] Int. Cl.[2] ..... A44B 19/00

[58] Field of Search ..... 24/206 R, 206 B; 2/237

[56] References Cited

UNITED STATES PATENTS

| | | | |
|---|---|---|---|
| 662,706 | 11/1900 | Bienenzucht | 24/206 R |
| 1,908,232 | 5/1933 | Freysinger | 24/206 R |
| 2,438,933 | 4/1948 | Markin | 2/237 |
| 2,895,170 | 7/1959 | Carlile | 24/206 B |

FOREIGN PATENTS OR APPLICATIONS

| | | | |
|---|---|---|---|
| 328,804 | 8/1935 | Italy | 24/206 B |

*Primary Examiner*—Bernard A. Gelak

*Attorney, Agent, or Firm*—Bucknam and Archer

[57] ABSTRACT

An adjustable fastening device comprises a slider and a rack which cooperate to adjustably fasten two parts of an article, or two separate articles, together. The slider has a guide ridge formed centrally on the internal surface of the top wall of its body, the guide ridge being adapted to be slidably received in a groove extending between two longitudinal rows of intersticed teeth on the rack.

1 Claim, 4 Drawing Figures

SLIDER FOR ADJUSTABLE FASTENING DEVICE

BACKGROUND OF THE INVENTION

This invention relates generally to adjustable fastening devices, and in particular to an adjustable fastening device of the type comprising a rack and a slider, the latter being releasably lockable in any selected position on the former so that articles, or parts of an article, attached to these two major components of the device can be adjustably fastened to each other. The invention is more specifically directed to the improved construction of the slider for use in such adjustable fastening device.

The adjustable fastening devices of the type above defined have been used extensively on the waistbands of garments such as trousers, skirts and jackets to properly fit the same on the wearer. The slider of the adjustable fastening device as heretofore made includes a body typically comprising a top wall, a pair of side walls, and a pair of inwardly directed ledges along the bottom edges of the respective side walls. The slider body is mounted astride the rack so as to be slidable therealong as guided by the side walls and the bottom ledges.

According to this conventional slider construction, the slider is easy to loosen or to become displaced from its properly engaged position upon the rack even when the latter is worn to the slightest degree due to the use of the device over an extended length of time. The smooth functioning of the slider and rack assembly can then be no longer expected. It may also be worth mentioning that the top wall of the slider body is constituted of a relatively thin plate only and is rather insufficient in strength in consideration of the high stresses that will be exerted thereon in the use of the adjustable fastening device on garments or like articles.

SUMMARY OF THE INVENTION

It is therefore a principal object of this invention to provide an adjustable fastening device broadly comprising a slider and a rack such that the slider can be stably mounted on the rack for smooth and trouble-free operation over prolonged periods of use of the device.

It is also an object of this invention to provide, in the adjustable fastening device of the type defined, a slider having a body which is of sufficient strength to withstand stresses exerted thereon in the use of the device.

Briefly, the slider for an adjustable fastening device according to the invention is intended for use with a rack of the type including two longitudinal rows of intersticed teeth which rows are spaced from each other by a groove extending substantially along the full length of the rack. The slider is adapted to be slidably mounted astride the rack so as to be releasably locked at any desired point thereon. Characteristically, the slider has a guide ridge formed internally on the top wall of its body. When the slider is mounted astride the rack, the guide ridge will be slidably received in the groove between the rows of teeth on the rack. The guide ridge serves the dual purpose of permitting the slider to slide smoothly and stably over the rack and of reinforcing the slider body.

The features which are believed to be novel and characteristic of this invention are set forth in particular in the appended claim. The invention itself, however, both as to its construction and manner of functioning, together with the further objects and advantages thereof, will become more apparent and understandable as the description proceeds, with reference had to the accompanying drawings in which like reference characters denote corresponding parts of the several views.

DESCRIPTION OF THE PREFERRED EMBODIMENT

Figure 1:
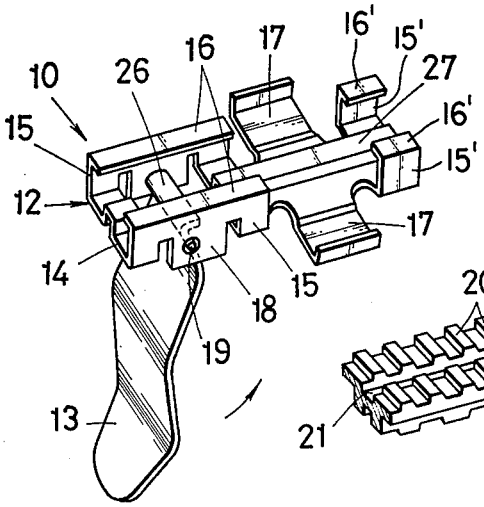
FIG. 1 is a perspective view of a slider for an adjustable fastening device constructed in accordance with the novel concepts of this invention, in which the slider is shown in an upsidedown disposition.
Figure 2:
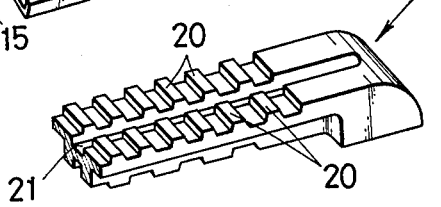
FIG. 2 is a partial perspective view of a rack for use with the slider shown in FIG. 1.

The adjustable fastening device to which the invention is directed is broadly constituted of a slider 10 shown in FIG. 1 and a rack 11 shown in FIG. 2. Referring first to FIG. 1, the slider 10 illustrated therein with its bottom side up includes a body 12 and a releasable locking or clamping member 13 which is pivotally coupled to the slider body adjacent one end thereof. The slider body 12 comprises a top wall 14, two pairs of side walls 15, 15' connected to the top wall and spaced apart from each other longitudinally along the top wall 14, a plurality of inwardly directed ledges 16, 16' each connected to a corresponding side wall 15, 15', and a pair of ears 17 extending laterally from the top wall. The side walls 15 include trunnions 18 between which the top wall 14 is opened and which have axially aligned bores therethrough to rotatably receive the integral pintles 19 of the locking member 13.

With reference to FIG. 2, the rack 11 for cooperative use with the slider 10 comprises two rows of intersticed teeth 20 which rows are spaced apart from each other by a groove 21 extending substantially along the full length of the rack.

Figure 3:
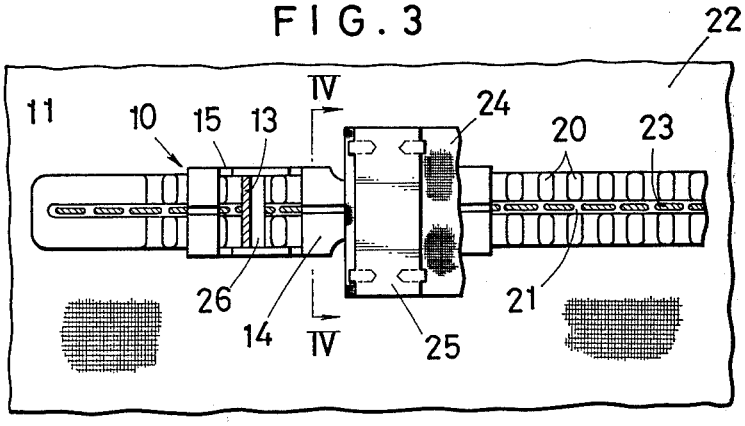
FIG. 3 is a partial top plan view of the adjustable fastening device incorporating the slider and the rack shown in FIGS. 1 and 2, respectively.
Figure 4:
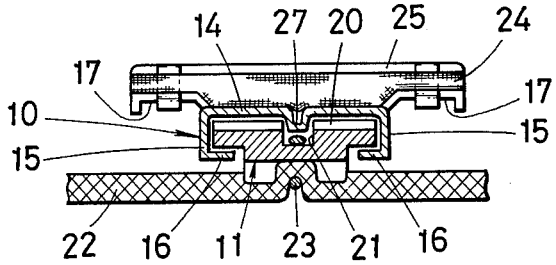
FIG. 4 is a sectional view taken along the plane of line IV—IV in FIG. 3.

As will be seen from FIGS. 3 and 4, the rack 11 is attached to a desired part 22 of a garment or like article with which the device is to be used by a line of stitches 23 extending along and received in the groove 21. The slider 10, on the other hand, is attached to another article part 24 by means of a separate anchoring plate 25 affixed to the ears 17 of the slider body 12 so as to securely hold the article part therebetween.

In the use of this adjustable fastening device, the slider 10 is mounted astride the rack 11, in such a manner that the top wall 14, side walls 15 and bottom ledges 16 of the slider body 12 cooperate to slidably engage the rack, as will be best understood from a consideration of FIG. 4. The slider 10 may be moved to a desired position on the rack 11 by pulling the locking member 13. By then turning the locking member in the direction marked by the arrow in FIG. 1, a hook or pawl 26 on one of its ends will engage the rack between two adjacent teeth 20 of each row so that the two article parts 22 and 24 can be adjustably fastened together.

The construction and operation of the adjustable fastening device as so far described are well known in the art. According to the novel concepts of this invention, a guide ridge 27 is formed centrally on the internal or lower surface of the top wall 14 of the slider body 12 so as to be slidably received in the groove 21 in the rack 11 when the slider is mounted astride the latter, as will be seen from FIGS. 1 and 4.

Thus, according to this invention, the slider 10 can be stably supported on the rack 11 not only by the side walls 15 with the bottom ledges 16 but by the central guide ridge 27. This arrangement permits the slider to slide smoothly over the rack, and the slider will not easily loosen or become displaced even when the rack is worn to some extent from the use of the adjustable fastening device over an extended length of time. As an additional advantage, the guide ridge serves to reinforce the slider body, so that the improved slider according to the invention will remain in highly operable condition throughout the life expectation of the adjustable fastening device.

It is believed that the objects of this invention are fully accomplished by the preferred form of the slider hereinbefore described. However, the structural details of the adjustable fastening device shown in the accompanying drawings are not meant to impose limitations upon the scope of the invention, as the inventive concepts are obviously applicable to other devices of more or less identical construction. The invention, therefore, should be construed broadly and in a manner consistent with the fair meaning or proper scope of the following claim.

What is claimed is:

1. In an adjustable fastening device of the type having a slider attached to a first part and adapted to be slidably mounted astride a rack attached to a second part so as to be releasably locked in any selected position thereon for adjustably fastening said first and second parts together, wherein said slider includes a body having a top wall, and wherein said rack includes two rows of intersticed teeth which rows are spaced apart from each other by a groove extending substantially along the full length of said rack, the improvement wherein said slider further comprises a guide ridge formed centrally on the internal surface of said top wall of said body, said guide ridge being adapted to be slidably received in said groove in said rack when said slider is mounted astride the latter said guide ridge extending longitudinally along and substantially over the full length of the top wall, said slider having two pairs of side walls connected to said top wall, said pairs of side walls being spaced-apart from each other longitudinally along the top wall, and a plurality of inwardly directed ledges each connected to a corresponding side wall, said top wall, side walls and ledges being positioned to slidably engage the rack to accommodate movement of the slider therealong, said top wall having a pair of laterally extending ears, disposed between said pairs of side walls and accommodating connection to the slider of said first part.

* * * * *